US011657994B2

(12) United States Patent
Pressouyre et al.

(10) Patent No.: US 11,657,994 B2
(45) Date of Patent: May 23, 2023

(54) PROTECTED SWITCH

(71) Applicant: CLEARSY, Aix-en-Provence (FR)

(72) Inventors: Guillaume Pressouyre, Simiane-Collongue (FR); Patrick Sauvage, Saint-Maximin (FR); Denis Sabatier, Aix-en-Provence (FR)

(73) Assignee: CLEARSY, Aix-en-Provence (FR)

( * ) Notice: Subject to any disclaimer, the term of this patent is extended or adjusted under 35 U.S.C. 154(b) by 48 days.

(21) Appl. No.: 17/605,403

(22) PCT Filed: Apr. 23, 2020

(86) PCT No.: PCT/EP2020/061302
§ 371 (c)(1),
(2) Date: Oct. 21, 2021

(87) PCT Pub. No.: WO2020/216825
PCT Pub. Date: Oct. 29, 2020

(65) Prior Publication Data

US 2022/0208493 A1 Jun. 30, 2022

(30) Foreign Application Priority Data

Apr. 24, 2019 (FR) ..... 1904314

(51) Int. Cl.
*H01H 31/00* (2006.01)
*H01H 33/59* (2006.01)
(Continued)

(52) U.S. Cl.
CPC ..... *H01H 47/002* (2013.01); *H01H 50/54* (2013.01)

(58) Field of Classification Search
CPC ..... H01H 47/00; H01H 50/54
See application file for complete search history.

(56) References Cited

U.S. PATENT DOCUMENTS 6,114,816 A * 9/2000 Nuckolls ..... H05B 41/42 315/324
6,611,416 B1 * 8/2003 Cleereman ..... H01H 47/002 361/189

(Continued)

FOREIGN PATENT DOCUMENTS

DE 35 41 338 5/1987
DE 44 41 171 2/1996

OTHER PUBLICATIONS

International Search Report for PCT/EP2020/061302 dated Aug. 6, 2020, 4 pages.

(Continued)

*Primary Examiner* — Jared Fureman
*Assistant Examiner* — Esayas G Yeshaw
(74) *Attorney, Agent, or Firm* — Nixon & Vanderhye

(57) ABSTRACT

A protected switch includes first and second electromechanical relays with guided contacts, each including an electromagnet and electrical contacts. A first contact of the first relay and a first contact of the second relay are connected in series in order to form a switching circuit. The switch further includes an interconnection circuit which connects at least a portion of the other electrical contacts of the first and second relays. The excitation of the first electromagnet is conditional on the state of the second relay and the excitation of the second electromagnet is conditional on the state of the first relay.

20 Claims, 5 Drawing Sheets

(51) Int. Cl.
*H01H 47/00* (2006.01)
*H01H 50/54* (2006.01)

(56) References Cited

U.S. PATENT DOCUMENTS

| | | | | |
|---|---|---|---|---|
| 6,636,410 | B2 | 10/2003 | Ide et al. | |
| 7,582,989 | B2 * | 9/2009 | Burr | H01H 47/005 307/115 |
| 2016/0197563 | A1 * | 7/2016 | Hurwitz | H02M 7/217 363/127 |
| 2018/0182587 | A1 * | 6/2018 | Koepf | H01H 71/28 |
| 2021/0388804 | A1 * | 12/2021 | Kleczewski | B60R 16/02 |

OTHER PUBLICATIONS

Written Opinion of the ISA for PCT/EP2020/061302 dated Aug. 6, 2020, 6 pages.
FR Patent Application No. 1904314 dated Jan. 10, 2020, 2 pages.

* cited by examiner

PROTECTED SWITCH

This application is the U.S. national phase of International Application No. PCT/EP2020/061302 filed Apr. 23, 2020 which designated the U.S. and claims priority to FR Patent Application No. 1904314 filed Apr. 24, 2019, the entire contents of each of which are hereby incorporated by reference.

TECHNICAL FIELD

The present invention relates to a protected switch and, more generally, to the field of electrical switching devices.

BACKGROUND

Safety electrical switching devices are known, such as relay-based switches, which are used to alternately enable or disable the flow of an electrical current in an electrical circuit.

Particularly known are switching devices containing one or more electromechanical relays, the contacts of which are connected together in series to form an electrical interrupting circuit, known as safety chain, which serves to electrically connect an electrical load to an electrical source, for example.

Depending on the relay state, the safety chain is switchable between an "off" state, in which at least one of the contacts is open, to prevent the flow of an electric current, and an "on" state, in which all the contacts are closed, to allow the flow of the current.

Such devices are typically used in control systems, for controlling railway facilities or equipment for example, and must meet high safety and reliability requirements.

In the absence of a control signal, such a device must be able to ensure that the safety chain is switched to an open state and thus the electrical load cannot be supplied. In particular, such a device must ensure that the safety chain cannot remain in an "on" state in the event of a failure, as a result of one of the contacts being kept in the closed state accidentally, for example.

For example, so-called intrinsic safety relays are known, in which the electrical contacts of the safety chain open under the effect of gravity when the relay is no longer energized, such as the NS1 relays defined in standard NF 70-030. However, these relays have the disadvantage of being heavy and bulky. They must also be installed with a particular orientation, according to the direction of the earth's gravity. Their use is therefore complicated. These relays are also difficult to miniaturize, which can be an obstacle to their use in certain applications.

On the other hand, devices containing two electromechanical relays are known, with guided contacts controlled by an electronic control unit that permanently measures the state of each of the two contacts. If one of these contacts remains closed while the corresponding relay is not controlled, then the control unit detects this and prevents the other relay from being energized, in order to maintain the safety chain in its "off" state.

However, such a device has the drawback of requiring a dedicated electronic control unit to measure the relay state, which requires a permanent power supply, in addition to being costly and complicating the facility and operation of the device.

Finally, DE 44 41 171 C1 describes a switching apparatus containing interconnected electromechanical relays. However, the operation of this device is unsatisfactory in certain circumstances, particularly with respect to the relay switching order upon a change of state.

The invention intends to remedy these drawbacks more particularly by proposing a protected switch with a simplified design for supplying electrical appliances and which, in the event of a failure ensures the opening of an electrical circuit in a safe manner.

SUMMARY

To this end, one aspect of the invention relates to a protected switch comprising:

- a first electromechanical relay with guided contacts comprising a first electromagnet and a plurality of electrical contacts;
- a second electromechanical relay with guided contacts comprising a second electromagnet and a plurality of electrical contacts, a first electrical contact of the first relay and a first electrical contact of the second relay being electrically connected in series between switch terminals;
- a rechargeable power supply;
- an interconnection circuit that connects at least a portion of the other electrical contacts of the first and second relays and wherein:
- the first electromagnet is connected to control electrodes of the switch, via second electrical contacts of the second relay and second electrical contacts of the first relay, to make the first electromagnet connection to the control electrodes conditional on the state of the second relay;
- the second electromagnet is connected to the control electrodes, via third and fourth electrical contacts of the first relay and said second electrical contacts, to alternately connect or disconnect the second electromagnet to the control electrodes depending on the state of the first relay, the third contact being a normally closed contact connected between the power supply and the first electromagnet, the fourth contact being a normally open contact connected between the power supply and the second electromagnet.

Thanks to the invention, the interconnection circuit makes the power supply to the electromagnet of each relay conditional, according to the state occupied by the other relay, which intrinsically ensures control over the state of the contacts of the interruption circuit, without the need for an electronic control unit.

Thus, if one of the two electrical contacts of the interrupt circuit fails and the relay to which it belongs is in an abnormal state, the other relay cannot be energized, thus keeping the other electrical contact of the interrupt circuit in the open state.

This intrinsic safety is achieved here without the use of the earth's gravity, thus reducing the mechanical complexity and size of the switch compared to known intrinsic relays. In addition, the switch is not dependent on the earth's gravity and can therefore be installed without orientation constraints.

In addition, the configuration of the interconnection circuit ensures that the opening or closing of the relays is done with a specific predefined sequencing, in particular to avoid the safety chain being in the "on" state when it should not be.

According to advantageous but non-mandatory aspects of the invention, such a switch may incorporate one or more of the following features, taken alone or in any technically permissible combination:

The control voltage of the first electromagnet is different from the control voltage of the second electromagnet.

The control voltage of the first electromagnet is greater than the control voltage of the second electromagnet, preferably greater than twice the control voltage of the second electromagnet.

The second contact of the first relay and the second contact of the second relay are connected in parallel with each other, the second contact of the first relay being a normally open contact, the second contact of the second relay being a normally closed contact.

The second electromagnet is further connected to one of the control electrodes via a fourth contact of the second relay, this fourth contact being a normally open contact.

The switch includes an electrical resistor, connected to the second electromagnet and configured to lower the electrical voltage across the energy reserve when the energy reserve is in a charging configuration.

The resistor is connected in series between the second electromagnet and the fourth contact of the second relay.

The energy reserve is a capacitor.

The amount of energy storable by the energy reserve is greater than or equal to the amount of energy required to power the second electromagnet in order to switch the second relay to an energized state.

BRIEF DESCRIPTION OF THE DRAWINGS

The invention will be better understood and other advantages thereof will become clearer in the light of the following description of an embodiment of a switch, given by way of example only and made with reference to the appended drawings, in which.

DETAILED DESCRIPTION OF SOME EMBODIMENTS

Figure 1:
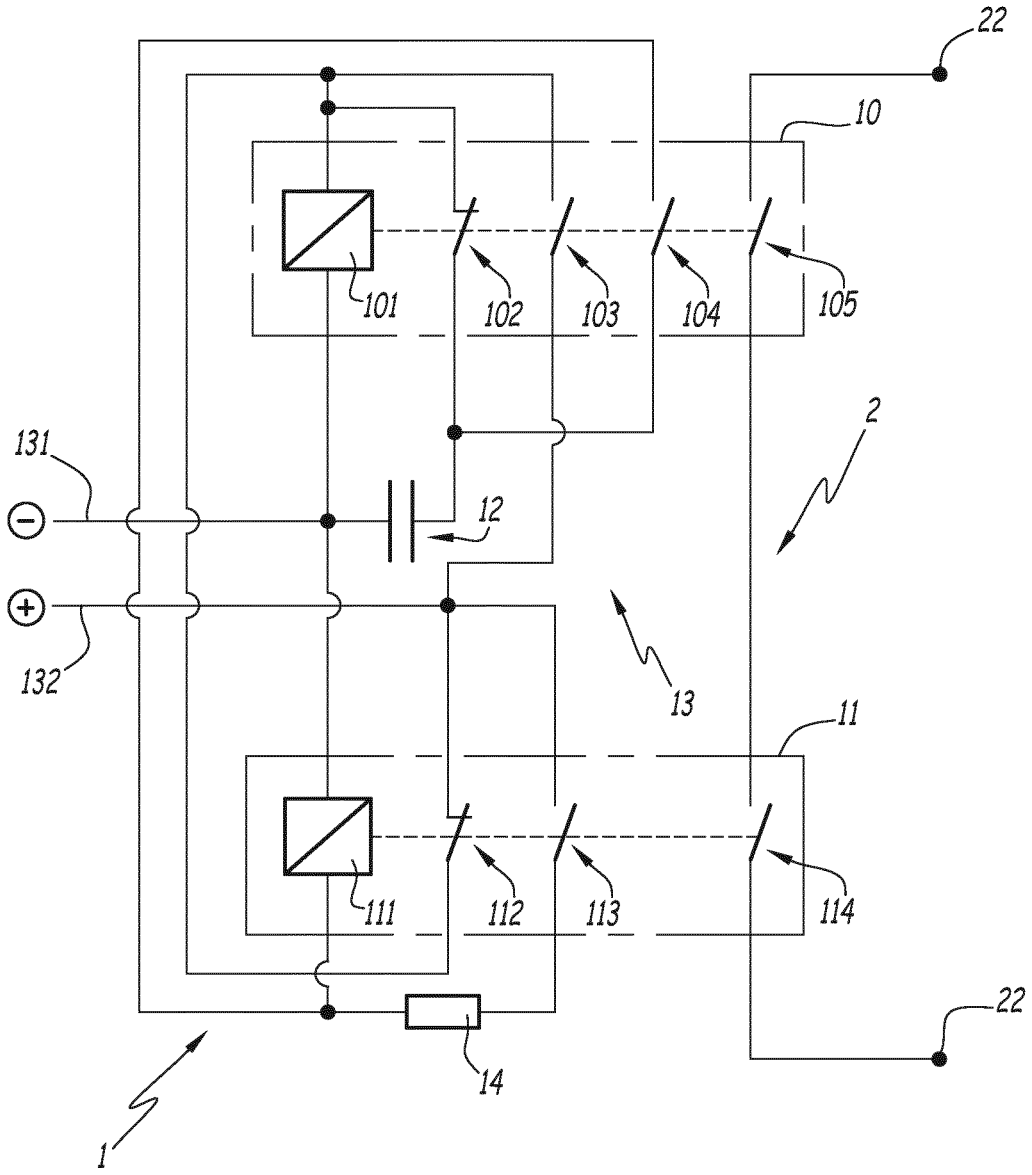
FIG. 1 shows, schematically, a switch in accordance with embodiments of the invention.

FIG. 1 shows a protected switch 1, which includes an interrupt circuit 2, also called a safety chain.

For example, the circuit 2 is intended to be connected to an electrical circuit, such as an electrical appliance to an electrical power source. For this purpose, the circuit 2 is provided with connection terminals 22.

The circuit 2 is selectively and reversibly switchable between a "off" state, which prevents the flow of an electric current through the circuit 2, and an "on" state, which allows the flow of an electric current through the circuit 2.

This switching is controlled here by supplying a control signal to control electrodes of the switch 1, which are designated here as 131 and 132.

In the absence of a control signal, the switch 1 remains in the "off" state and, in the presence of a control signal, the switch 1 switches to the "on" state.

In this example, the control signal is an electrical voltage, noted Vcc, applied between the electrodes 131 and 132.

As an illustrative example, the electrical voltage Vcc is a DC voltage, with an amplitude greater than or equal to 24 V and less than or equal to 110 V. The switch 1 is configured to ensure safe switching of the circuit 2 between its off and on states, in particular to prevent the circuit 2 from remaining in the "on" state while no control signal is applied to the switch 1.

Preferably, the switch 1 has a high safety level, such as "SIL 4" on the safety integrity level scale as defined by the IEC 61508 standard of the International Electrotechnical Commission or by the EN 50129 standard.

Preferably, the switch 1 is intended for use in a control system, such as in the railway field. In variants, the switch 1 may also be used in a power circuit to control the power supply of an electrical device.

As an illustrative and not necessarily limiting example, the circuit 2 is adapted to receive a DC electrical signal between its terminals 22, having an electrical voltage less than or equal to 110 volts and an electrical current less than or equal to 3.5 A.

As illustrated in the example of FIG. 1, the switch 1 comprises a first electromechanical relay 10, a second electromechanical relay 11 and an interconnection circuit 13 that connects the relays 10 and 11 to each other, as explained in the following. Advantageously, the switch 1 also comprises an outer casing, not shown, made of plastic for example, inside which the components of the switch 1 are housed. By way of illustrative example, the casing may have the shape of a block with dimensions of 12 cm×9 cm×2 cm, for example.

The relay 10 includes an electromagnet 101 and movable electrical contacts 102, 103, 104 and 105 coupled with the electromagnet 101. Each of the contacts 102, 103, 104 and 105 is switchable between an open and a closed state.

In this example, contact 102 is of the "normally closed" type, while contacts 103, 104 and 105 are of the "normally open" type.

Switching is accomplished by means of electromagnet 101, also referred to as coil 101 in the following, which exerts an electromagnetic force on the contacts 102, 103, 104 and 105 when electrically energized.

When the electromagnet 101 is not energized, the relay 10 remains in an inactive state, also known as the quiescent state, and the contacts 102, 103, 104 and 105 remain in a corresponding quiescent state. Here, in the quiescent state, the "normally closed" contact 102 remains closed, while the contacts 103, 104 and 105 remain open. In FIG. 1, the relay 10 is shown in its inactive state.

When the electromagnet 101 is electrically energized, here by the control signal, then the contacts 102, 103, 104 and 105 switch to their opposite states. Here, the contact 102 opens, while the contacts 103, 104 and 105 close. The relay 10 is said to be activated or energized. As long as the electromagnet 101 is energized, the contacts 102, 103, 104 and 105 are kept in that state and the relay 10 remains energized.

The relay 10 here is an electromechanical guided contact relay, i.e., the contacts 102, 103, 104, and 105 are mechanically coupled together. Such a relay with guided contacts is described by the NF EN 50205 standard, for example.

Thus, if one of the contacts 102, 103, 104 and 105 accidentally remains locked in a given state, regardless of the state of the electromagnet 101, then the other contacts 102, 103, 104 and 105 are kept locked in a corresponding state. For example, if the contact 102 remains locked in the open state even in the absence of energization of electromagnet 101, then contacts 103, 104 and 105 remain in the closed state. The relay 10 then remains locked in the energized state. In other words, the contacts of such a relay cannot switch between their open and closed states independently of each other.

Similarly, the relay 11 includes an electromagnet 111 and movable electrical contacts 112, 113 and 114 coupled to the electromagnet 111. Each of the contacts 112, 113, and 114 is switchable between an open state and a closed state by means of the electromagnet 111. In this example, contact 112 is of the "normally closed" type, while contacts 113 and 114 are of the "normally open" type. In FIG. 1, the relay 11 is shown in its inactive state. The relay 11 is also an electromechanical relay with guided contacts.

The contacts 105 and 114 are electrically connected in series with each other to form the interrupt circuit 2. Thus, the circuit 2 is in the "off" state when at least one of the contacts 105 and 114 is open, and is in the "on" state only when both contacts 105 and 114 are closed.

Advantageously, the relays 10 and 11 belong to different manufacturing series and/or come from different manufacturers. This considerably reduces the risk that the relays 10 and 11 are both affected simultaneously by the same manufacturing defect that could compromise their operation.

Preferably, the relay 10 comprises a housing inside which the electromagnet 101 and the contacts 102, 103, 104 and 105 are housed. Similarly, the relay 11 comprises a housing inside which the electromagnet 111 and the contacts 112, 113 and 114 are housed.

In a variant, the switch 1 may further include one or more additional interrupt circuits, similar to the interrupt circuit 2. For example, the relays 10 and 11 may include additional movable, "normally open" type contacts that are mechanically coupled with contacts 102, 103, 104, 105 or 112, 113 and 114, respectively. Each additional interrupt circuit may include an additional contact of the first relay 10 and an additional contact of the second relay 11, electrically connected in series. What is described with reference to the interrupt circuit 2 therefore also applies to these additional interrupt circuits.

According to another embodiment, the relays 10 and 11 may include additional contacts that are not connected to the interconnection circuit 13 or to the interrupt circuit 2.

Advantageously, the switch 1 further comprises a resistor 14 connected in series between the electromagnet 111 and the contact 113 of the second relay 11. According to examples, the resistor 14 is a wound resistor, although in a variant other embodiments are possible.

For example, the resistor 14 forms a voltage divider bridge that allows the electrical voltage present across the terminals of the energy reserve 12 to be lowered when the energy reserve 12 is in a charging configuration, such as when the contacts 104 and 113 are closed and the control voltage Vcc is applied across the terminals 131 and 132.

Advantageously, the switch 1 includes a rechargeable energy reserve 12, the role of which is described in more detail in the following. For example, the energy reserve 12 is a capacitor.

Preferably, the electromagnet 101 of the first relay 10 has a different control voltage than the control voltage of the electromagnet 111 of the second relay 11.

The term "control voltage" here refers to the electrical voltage that must be applied across the electromagnet terminals to energize the relay. In other words, the relay is not energized if a voltage less than the control voltage is applied across the electromagnet terminals.

Preferably, the control voltage of the electromagnet 101 of the first relay 10 is greater than the control voltage of the electromagnet 111 of the second relay 11, preferably still greater than twice the control voltage of the electromagnet 111.

For example, the control voltage of the electromagnet 101 of the first relay 10 is equal to 24 volts. The control voltage of the electromagnet 111 of the second relay 11 is equal to 6 volts.

Advantageously, the energy reserve 12 is dimensioned so that the electric voltage it delivers when discharging, once the relays 10 and 11 are energized, is strictly lower than the control voltage of the electromagnet 101 of the first relay 10 while being higher than the control voltage of the electromagnet 111 of the second relay 11.

Preferably, the amount of energy storable by the energy reserve, noted E, is greater than or equal to the amount of energy, noted Emin, that is required to power the second electromagnet 111 so as to switch the second relay 11 from the inactive state to the energized state. For example, the amount of energy E is greater than or equal to the amount of energy Em in and is less than or equal to 1.5×Emin, or less than or equal to 1.2×Emin.

As an illustrative example, the energy reserve 12 is a capacitor with a capacity equal to 47 μF. The electromagnet 111 here has a resistance equal to 500Ω The interconnection circuit 13 connects the relays 10 and 11 to each other and, more specifically, connects the electromagnets 101, 111 and the contacts 102, 103, 104, 112, 113 to each other, as described below. The interconnection circuit 13 further connects the power supply 12 to the relays 10 and 11.

Preferably, the circuit 13 is electrically isolated from the interrupt circuit 2.

For example, the circuit 13 comprises a substrate on which electrically conductive tracks are formed. The relays 10 and 11 are mounted on this substrate and electrodes corresponding to the electromagnets 101, 111 and corresponding contacts are connected to these electrically conductive tracks.

In a variant, the circuit 13 may be implemented using cables to connect the relays 10 and 11.

In this example, the circuit 13 includes the control electrodes 131 and 132. In a variant, the circuit 13 may include other control electrodes, such as a pair of control electrodes dedicated to each of the electromagnets 101 and 111 and intended to receive a same control signal to control the switch 1.

Figure 2:
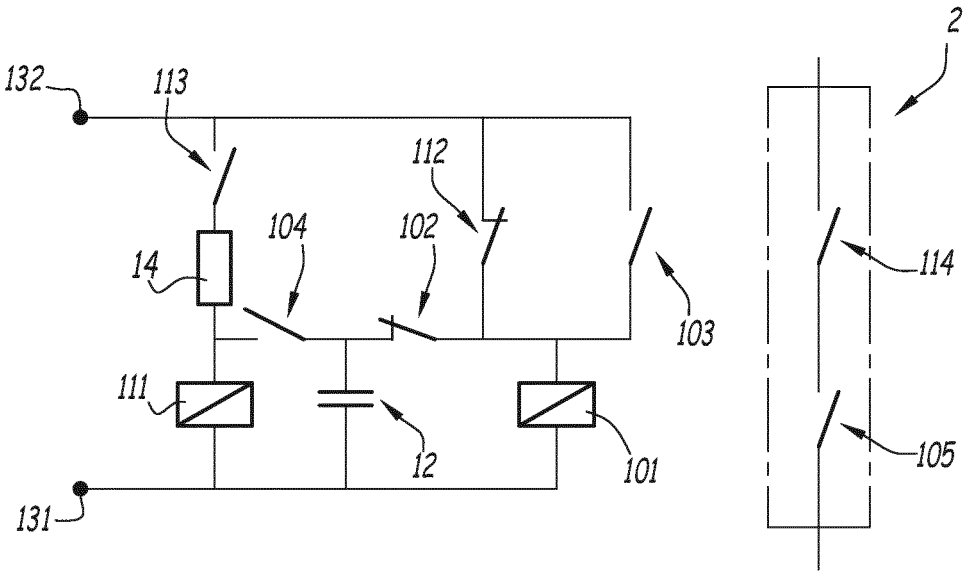
FIG. 2 shows, schematically, the equivalent electrical diagram of the switch of FIG. 1, in a first state during its operation.

FIG. 2 shows the electrical diagram of the switch 1 when the circuit 13 connects the relays 10 and 11 and the relays 10 and 11 are inactive.

In this example, the first electromagnet 101 is connected to the control electrodes 131, 132 via the contact 112 and contact 103. More specifically, the contact 103 and contact 112 are connected in parallel with each other. Both the contact 103 and the contact 112 are connected between the electrode 132 and a first terminal of the electromagnet 101. A second terminal of the electromagnet 101 is connected to the other electrode 131.

In this manner, the connection of the electromagnet 101 to the control electrodes 131, 132 is conditional on the state of the second relay 11.

The second electromagnet 111 is connected here to the control electrodes 131, 132 via the contacts 102, 104 and 103 to alternately connect or disconnect the second electromagnet 111 to the control electrodes 131, 132, depending on the state of the first relay 10.

In addition, the energy reserve 12 is connected to the electrodes 131, 132 and the second electromagnet 111 via the contacts 102 and 104. The circuit 13 is thus arranged so that the contacts 102 and 104:

authorize charging the energy reserve 12 from the control electrodes 131, 132 when the contact 105 is open, and allow the energy reserve 12 to be discharged into the second electromagnet 111 when the first contact 105 is closed.

For this purpose, the contact 104 connects a terminal of the second electromagnet 111 to a first terminal of the energy reserve 12. A second terminal of the energy reserve 12 and the other terminal of the electromagnet 111 are connected here to the electrode 131. The contact 102 connects the first terminal of the energy reserve 12 to a first terminal of the electromagnet 101 to which the contacts 103 and 112 are connected.

Thus, the energy reserve 12 can only be connected to the electrode 132 through the contacts 102 or 104.

The second electromagnet 111 is further connected to the control electrode 132 through the contact 113 of the second relay 11.

Due to the configuration of the circuit 13, when a control signal is received at the control electrodes 131, 132, the relays 10 and 11 are switched sequentially, one after the other, to their active state.

Switching is prevented, however, if one of the relays 10, 11 is initially in an abnormal state, because one of the contacts 105 or 114 is stuck in the closed state for example. The circuit 2 then remains in the blocked configuration, which ensures that the switch circuit 1 remains in the open state.

The connection of the electromagnets 101 and 111 to the electrode 132 through the contacts 103 and 113, respectively, ensures that the corresponding relay 10, 11 remains in the energized state once this relay has switched to the energized state and provided a control signal is present.

Furthermore, when the control signal ceases to be received at the electrodes 131, 132, if one of the contacts 105 or 114 remains locked in the closed state, then switching the other contact 105, 114 is prevented.

Thus, a functional failure of either contact 105, 114, as a result of sticking in the closed state caused by a partial melting of the contact, for example, causes the circuit 2 to switch to the "off" state. This keeps the switch 1 in a safe state.

In contrast, if the control signal received on the electrodes 131, 132 were directly applied simultaneously to the electromagnets 101 and 111 without these being conditional on the contacts of the individual relays 10 and 11, then the switching of the relays 10 and 11 would be simultaneous regardless of the state of either relay 10, 11.

Thanks to the invention, when the switch 1 is switched, the control of the state of the contacts 105, 114 is carried out intrinsically, without calling upon an external electronic control unit, and also without calling upon a mechanical device dependent on the earth's gravity for its operation.

In addition, the relays 10 and 11 experience different wear and tear due to the chosen switching sequence. For example, the second relay 11 tends to wear out more quickly than the first relay 10 because it undergoes current calls more frequently than the first relay 10, particularly during the closing sequence of the safety chain. This differentiated wear prevents both relays 10 and 11 from suffering a simultaneous failure due to the same cause of wear.

According to a variant not shown, the second electromagnet 111 may be connected to second control electrodes. For example, the contact 113 may connect the electromagnet 111 to a second electrode separate from the electrode 132. In a variant, the contact 102 may connect the first terminal of the power supply 12 to this second electrode. The control signal is then applied to both these second control electrodes and to the electrodes 131 and 132.

An example of the operation of the switch 1 is now described, with reference to FIGS. 2 through 5. In this example, the circuit 2 is switched from the "off" state to the "on" state in response to a control signal.

As illustrated in FIG. 2, the relays 10 and 11 are initially inactive. The contacts 102 and 112 are in the closed state, while the contacts 103, 104, 105, 113, 114 are in the open state. No control signal is applied between the electrodes 131, 132. The contacts 105, 114 are in the open state and the circuit 2 is therefore in a "off" state.

At this point, the energy reserve 12 is not able to supply power to the coil 101 to activate the first relay, in particular because the maximum voltage that the energy reserve 12 can deliver is lower than the control voltage of the coil 101. Moreover, in practice, the energy reserve 12 is usually empty or partially discharged at this point.

The energy reserve 12 can then discharge into the coil 101 without being able to change the state of the relay 10, since it cannot provide enough energy.

Figure 3:
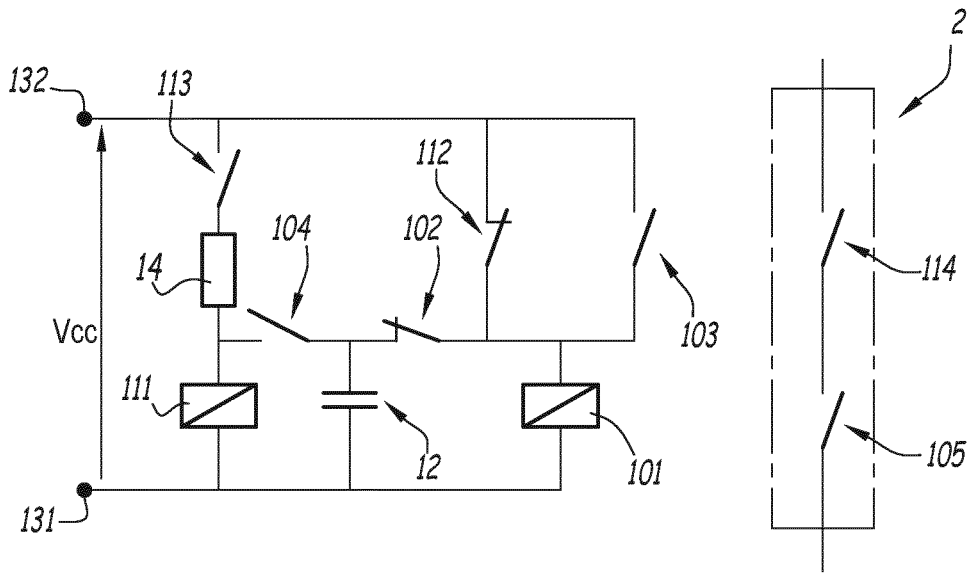
FIG. 3 shows, schematically, the equivalent electrical diagram of the switch of FIG. 1, in a second state during its operation.

As shown in FIG. 3, a control signal, such as an electrical voltage Vcc, is applied between electrodes 131 and 132.

On the one hand, the energy reserve 12 is connected to the electrode 132 via the contacts 102 and 112, both of which are in the closed state. In parallel, the electromagnet 101 is connected to the electrode 132 through the contact 112. At this point, the contact 112 is in the closed state and the contact 103 is in the open state. In the example shown in FIG. 3, the electrical voltage applied across the terminals of the energy reserve 12 is equal to the electrical voltage applied across the terminals of the first electromagnet 101. This electrical voltage is greater than the control voltage of the first electromagnet 101, for example.

As the coil 101 is supplied with a voltage greater than its control voltage, the relay 10 is energized. For example, the coil 101 generates an electromagnetic force that causes the contacts 102, 103, 104 and 105 to switch.

Figure 4:
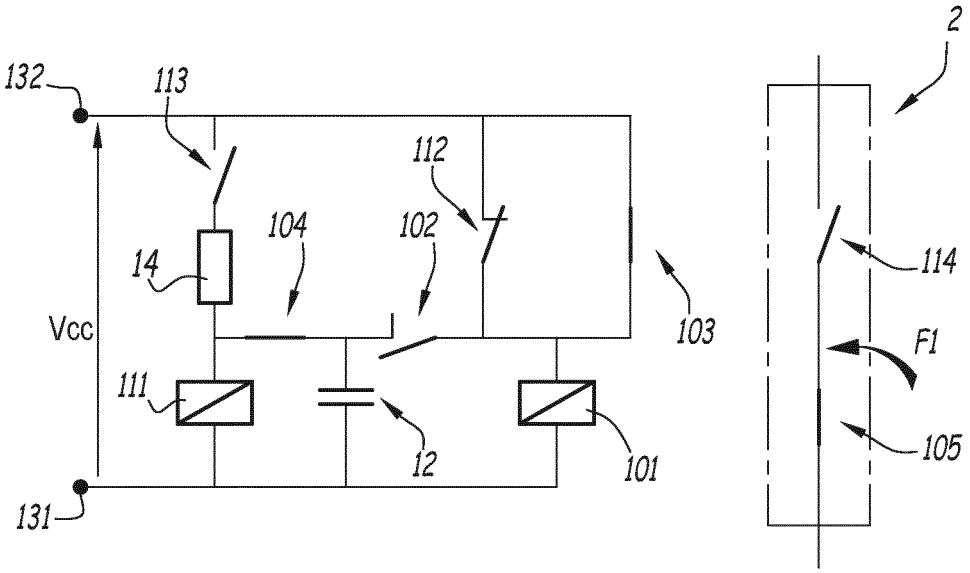
FIG. 4 shows, schematically, the equivalent electrical diagram of the switch of FIG. 1, in a third state during its operation.

Thus, as shown in FIG. 4, the relay 10 switches to the energized state. The contact 102 opens and the contacts 103, 104 and 105 close. Arrow F1 illustrates the closing of contact 105.

In practice, this switching is not instantaneous, but occurs after an initial switching time, for example less than or equal to 100 ms.

At this stage, the control signal is maintained on the electrodes 131, 132. The circuit 2 is still in an "off" state, which prevents the flow of current through the circuit 2.

The electromagnet 101 continues to be powered, this time through the contact 103, which is closed. This ensures that the relay 10 remains in the energized state as long as the control signal is supplied to the switch 1.

However, due to the new configuration of the contacts 103, 104 and 102 after the switching of the relay 10, the energy reserve 12 is no longer connected to the electrode 132 and therefore no longer electrically recharged from the voltage Vcc. In fact, the contact 102 is now in the open state and the contact 113 is still in the open state.

On the other hand, since the contact 104 is closed, the electromagnet 111 is connected with the energy reserve 12, which allows the energy reserve 12 to discharge into electromagnet 111, to electrically supply the latter.

Figure 5:
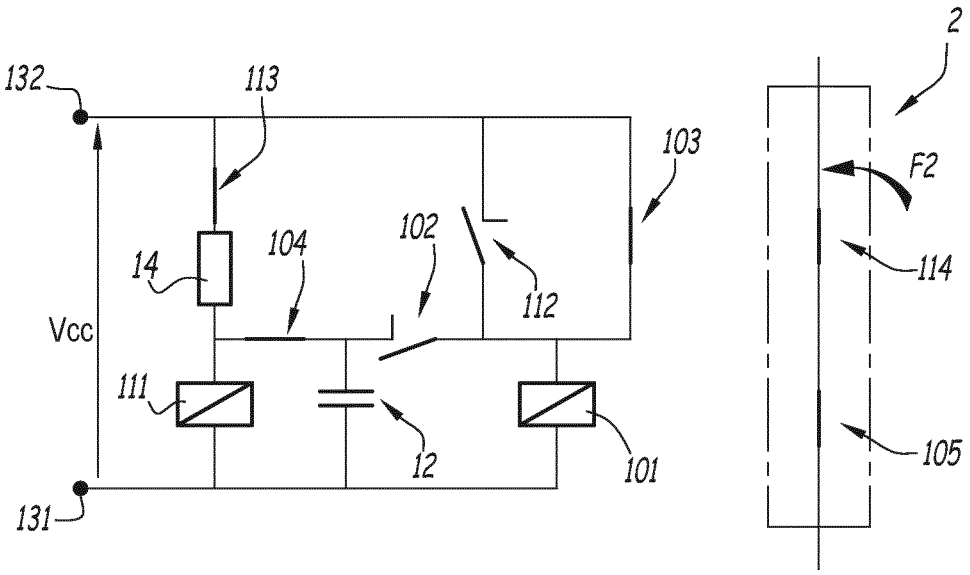
FIG. 5 shows, schematically, the equivalent electrical diagram of the switch of FIG. 1, in a fourth state during its operation.

In this way, as the voltage supplied by the energy reserve 12 is greater than the control voltage of the electromagnet 111, the electromagnet 111 triggers the switching of the relay 11 to the energized state, as shown in FIG. 5. The contact 112 opens and the contacts 113 and 114 close. Arrow F2 illustrates the closing of the contact 114.

In practice, this switching is not instantaneous, but occurs after a second switching time, of less than or equal to 100 ms for example.

Thus, the circuit 2 switches to the "on" state, thus authorizing the flow of an electric current.

At the end of this switching, the electromagnet 111 continues to be powered, this time through the contact 113, which is closed. This ensures that the relay 11 is kept in the energized state as long as the control signal is supplied to the switch 1.

In addition, through the resistor 14, the electrical voltage applied to the terminals of the energy reserve 12 is decreased to a holding voltage with a predefined value, chosen to ensure that only a small amount of energy is actually reserved in the energy reserve 12. This ensures, among other things, that the relay 11 can be switched quickly when the control signal is interrupted, since the energy reserve 12 will not be able to hold the relay 11 in the energized state for too long.

When the control signal is interrupted, the electromagnets 101 and 111 cease to be energized. The relays 10 and 11 return to their inactive state. The contacts 102, 112 close, while applied to the terminals of the energy reserve contacts 103, 104, 105, 113 and 114 reopen. The circuit 2 then switches to the "off" state.

Although the energy reserve 12 may be transiently connected to the electromagnet 111 when applied to the terminals of the energy reserve relays 10 and 11 return to their inactive state, it does not contain sufficient energy to energize applied to the terminals of the energy reserve relay 11 again.

Furthermore, the energy reserve 12 is equally unable to energize the relay 10 at the end of switching, because although it is connected to the electromagnet 101 via the relay 102, which returns to its closed state once the relay 10 returns to its inactive state, the voltage supplied by the energy reserve 12 remains lower than the control voltage necessary to energize the electromagnet 101.

The operation of the switch 1 is said to be "safe" in that it ensures that the circuit 2 cannot switch to the "on" state if either contact 105 or 114 remains stuck in the closed state when the control signal is absent.

In particular, in this example, if the contact 105 is initially abnormally stuck in its closed state, then the contact 114 cannot be closed when a control signal is subsequently applied. Indeed, since the contacts of the relay 10 are coupled together, then the contacts 104 and 103 are closed and the contact 102 is open when the contact 105 is closed, even in the absence of power to the electromagnet 101. In this case, the electromagnet 111 is disconnected from the electrode 132, because the contacts 102 and 113 are open. The electromagnet 111 is only connected to the energy reserve 12, which at this stage does not contain sufficient energy to switch the relay 11. The electromagnet 111 cannot therefore be energized and therefore the relay 11 cannot be switched to the energized state. The circuit 2 remains in the "off" state.

In the case where the contact 114 is initially abnormally stuck in its closed state, then the contact 105 cannot be closed when a control signal is subsequently applied. In fact, since the contacts of the relay 11 are coupled together, then the contact 113 is closed and the contact 112 is open when the contact 114 is closed, even in the absence of power to the electromagnet 111. In this case, the electromagnet 101 is disconnected from electrode 132, because the contacts 112 and 103 are open. The electromagnet 101 cannot therefore be energized and therefore the relay 10 cannot be switched to the energized state. The circuit 2 remains in the "off" state.

Such a failure of the switch 1 therefore leads to the circuit 2 remaining in a safe configuration.

The probability of simultaneous failure of the contacts 105 and 114 is extremely low here, less than 10-9 occurrences per hour for example, which guarantees a good safety level for the switch 1.

The embodiments and variants contemplated above may be combined with each other to generate new embodiments.

The invention claimed is:

1. A switch comprising:

a first electromechanical relay with guided contacts comprising a first electromagnet and a plurality of electrical contacts;

a second electromechanical relay with guided contacts comprising a second electromagnet and a plurality of electrical contacts, a first electrical contact of the first relay and a first electrical contact of the second relay being electrically connected in series between terminals of the switch;

a rechargeable energy reserve;

an interconnection circuit, which connects at least some of the other electrical contacts of the first and second relays and wherein:

the first electromagnet is connected to control electrodes of the switch via second electrical contacts of the second relay and second electrical contacts of the first relay to condition the connection of the first electromagnet to the control electrodes to the state of the second relay;

the second electromagnet is connected to the control electrodes via third and fourth electrical contacts of the first relay and said second electrical contacts for alternately connecting or disconnecting the second electromagnet to the control electrodes depending on the state of the first relay, the third contact being a normally closed contact connected between the energy reserve and the first electromagnet, the fourth contact being a normally open contact connected between the energy reserve and the second electromagnet.

2. The switch according to claim 1, wherein the control voltage of the first electromagnet is different from the control voltage of the second electromagnet.

3. The switch according to claim 2, wherein the control voltage of the first electromagnet is greater than the control voltage of the second electromagnet.

4. The switch according to claim 3, wherein the second contact of the first relay and the second contact of the second relay are connected in parallel with each other, the second contact of the first relay being a normally open contact, the second contact of the second relay being a normally closed contact.

5. The switch according to claim 3, wherein the second electromagnet is further connected to one of the control electrodes via a fourth contact of the second relay, this fourth contact being a normally open contact.

6. The switch according to claim 3, wherein the switch comprises an electrical resistor connected to the second electromagnet, configured to lower the electrical voltage across the energy reserve when the energy reserve is in a charging configuration.

7. The switch according to claim 1, wherein the second contact of the first relay and the second contact of the second relay are connected in parallel with each other, the second contact of the first relay being a normally open contact, the second contact of the second relay being a normally closed contact.

8. The switch according to claim 7, wherein the second electromagnet is further connected to one of the control electrodes via a fourth contact of the second relay, this fourth contact being a normally open contact.

9. The switch according to claim 7, wherein the switch comprises an electrical resistor connected to the second electromagnet, configured to lower the electrical voltage across the energy reserve when the energy reserve is in a charging configuration.

10. The switch according to claim 1, wherein the second electromagnet is further connected to one of the control electrodes via a fourth contact of the second relay, this fourth contact being a normally open contact.

11. The switch according to claim 10, wherein the switch comprises an electrical resistor connected to the second electromagnet, configured to lower the electrical voltage across the energy reserve when the energy reserve is in a charging configuration.

12. The switch according to claim 2, wherein the control voltage of the first electromagnet is greater than twice the control voltage of the second electromagnet.

13. The switch according to claim 2, wherein the second contact of the first relay and the second contact of the second relay are connected in parallel with each other, the second contact of the first relay being a normally open contact, the second contact of the second relay being a normally closed contact.

14. The switch according to claim 2, wherein the second electromagnet is further connected to one of the control electrodes via a fourth contact of the second relay, this fourth contact being a normally open contact.

15. The switch according to claim 2, wherein the switch comprises an electrical resistor connected to the second electromagnet, configured to lower the electrical voltage across the energy reserve when the energy reserve is in a charging configuration.

16. The switch according to claim 2, wherein the energy reserve is a capacitor.

17. The switch according to claim 1, wherein the switch comprises an electrical resistor connected to the second electromagnet, configured to lower the electrical voltage across the energy reserve when the energy reserve is in a charging configuration.

18. The switch according to claim 1, wherein the second electromagnet is further connected to one of the control electrodes via a fourth contact of the second relay, this fourth contact being a normally open contact, wherein the switch comprises an electrical resistor connected to the second electromagnet, configured to lower the electrical voltage across the energy reserve when the energy reserve is in a charging configuration, and wherein the resistor is connected in series between the second electromagnet and the fourth contact of the second relay.

19. The switch according to claim 1, wherein the energy reserve is a capacitor.

20. The switch according to claim 1, wherein the amount of energy storable by the energy reserve is greater than or equal to the amount of energy required to energize the second electromagnet to switch the second relay to an energized state.

* * * * *